United States Patent [19]

Weissmann

[11] 4,059,214

[45] Nov. 22, 1977

[54] FORGING PROCESS

[75] Inventor: Gerd Weissmann, Munich, Germany

[73] Assignee: Bayerisches Leichtmetallwerk Graf Bluchervon Wahlstatt KG, Munich, Germany

[21] Appl. No.: 637,837

[22] Filed: Dec. 4, 1975

[30] Foreign Application Priority Data

Dec. 10, 1974 Germany ..... 2458291

[51] Int. Cl.[2] ..... B23K 19/00

[52] U.S. Cl. ..... 228/265; 29/420.5; 29/159.2

[58] Field of Search ..... 29/159.2, 420.5; 228/141, 173 A; 75/208 R

[56] References Cited

U.S. PATENT DOCUMENTS

| | | | |
|---|---|---|---|
| 1,951,174 | 3/1934 | Simons | 75/208 R X |
| 2,331,909 | 10/1943 | Hensel et al. | 75/208 R X |
| 3,535,762 | 10/1970 | Taylor | 29/159.2 |
| 3,648,343 | 3/1972 | Haller | 228/141 X |
| 3,752,003 | 8/1973 | Dunn et al. | 29/159.2 X |
| 3,832,763 | 9/1974 | Schobler | 29/159.2 |

*Primary Examiner*—James L. Jones, Jr.
*Assistant Examiner*—K. J. Ramsey

[57] ABSTRACT

Unitary workpieces are produced from at least two components, one of which is a body made from smelt-metallurgical material and the other is a member made from powder-metallurgical material interconnected in a hole-and-plug arrangement. The components are located in respective die halves of a forging press and are forged into a desired shape under such conditions of heat and pressure so as to upset the material of each of the components at least along the juncture of their interconnection to simultaneously form a welded bond therebetween.

10 Claims, 9 Drawing Figures

FORGING PROCESS

BACKGROUND OF THE INVENTION

The present invention relates to a process for forming a unitary workpiece from two independent parts and in particular to the formation of workpieces of this type in which the individual parts are of different materials, and wherein at least one of the parts is to be forged into a desired shape.

In British Pat. No. 1,265,137 a shaft and a gearwheel of different materials but each made by smelt-metallurgical methods are joined together in a forging process. It is also known from British Pat. No. 960,013 to unite a shaft and a wheel of the same grade of material by the common up-setting of the components, under the action of a forming closure. In this process locally confined resistance welding is possible in the junction zone, without any significant flow of material taking place.

U.S. Pat. No. 3,678,558 illustrates the production of gearwheels from two finished preformed components. In this process a gearwheel manufactured by powder-metallurgy is joined to a gearwheel manufactured by smelt-metallurgy by welding or adhering the parts without any resultant change in the form of the gearwheels. U.S. Pat. No. 3,727,999 illustrates the production of a bevel-gear formed of two correspondingly shaped rings, one fitted inside the other. Each of the rings were manufactured separately by powder-metallurgy processes and each had an alloy composition adapted to absorb different stresses. After formation of each of the rings, they were united together in a pressing process. If desired a still further consolidation could be accomplished by a subsequent hot-forging.

Finally, it is known from U.S. Pat. No. 3,772,935 to produce workpieces having differently stressed surfaces by separately placing together two powdered metals of different composition in a mold. The two layers of powder being thereafter pressed together and sintered.

As opposed to the complex and limited processes of the prior art, the present invention provides a process by which components of different materials may be simply and economically joined in a hole-and-plug connection, having a strong welded or bonded juncture, and simultaneously forged with a desired finished shape and in particular providing for an economical combination of simple and complicated forms of workpieces taking into account the differing demands to be placed on the properties of the materials.

SUMMARY OF THE INVENTION

According to the present invention unitary workpieces are produced from at least two components, one of which is a body made from smelt-metallurgical material and the other is a member made from powder-metallurgical material interconnected in a hole-and-plug arrangement. The components are located in respective die halves of a forging press and are forged into a desired shape under such conditions of heat and pressure so as to upset the material of each of the components at least along the juncture of their interconnection to simultaneously form a welded bond therebetween.

In the practice of the present invention, the powdered metallurgical material, sinters, densifies and hardens while simultaneously uniting in a strong bond with the smelt-metallurgical material, preferably steel, or cast steel. The juncture between the two components, because of the upsetting of the material, deforms from its initial state producing a curved juncture having great physical as well as chemical bonding strength.

A preferred application of the present invention is found in the production of such workpieces, as combined bevel-gear and spindle assemblies, in which the spindle is formed from bar steel blank as the smelt-metallurgical body and the bevel gear is formed from ring shaped blank as the sinterable powder-metallurgical member. The shaft is located in the fixed lower half of the forge press and extends therefrom to penetrate into the sintered member, which is held in the upper die half of the press. The sintered blank, may be pre-pressed or cut into the approximate final shape and pre-sintered, and both the body and the sinterable member may be provided with conical or cylindrical hole-and-plug sections. The final forging, in accordance with the present invention completes the formation of the bevelgear, and its uniting with the spindle in a firm welded junction having a completely curved interface joint. The interface junction may be made in various curves or arcuate forms by selecting the contours of the hole and plug interfaces in the two components. Conical, cylindrical or rounded interfaces may be selected, and the degree of taper, roundness as well as the diametric extent will affect the curvature of the juncture.

The components may, in accord with the present invention, be heated before the dies are closed. Preferably, however, at least the powdered-metallurgical member and the adjacent interconnected end of the smelt member are heated to at least the forging temperature, with the powder-metallurgy member being heated to a higher temperature than the other body. The forging process may be advantageously carried out under a blanket of protective inert gas, to avoid oxidation.

In accordance with the present invention there is further provided an improved construction of forging press which the lower die half is provided with a central bore for receipt of the shaft like blank, employed to form the unitary bevel gear and spindle. The upper end of the spindle blank is adapted to extend outwardly of the hole, to penetrate the gear-blank and is supported against a spring-loaded centering bolt, located in the upper die half. As a result stability of the spindle is assured during closure of the forging press.

The present process results in an exceptionally intimate union of the sintered forming member and the forming body, as a result of the forging heat and the reforming of the material in the junction zone. A conical construction of the two contact surfaces to be united can produce a particularly high degree of consolidation of the material and consequently an exceptionally intimate connection.

Full details and examples of the present invention are set forth in the following disclosure and are illustrated in the accompanying drawings.

DESCRIPTION OF THE INVENTION

In the following disclosure, reference is made to components of different materials. For illustration and example one component is defined as being formed of a material which is smelted or formed by smelt-metallurgy. Steel, cast steel or the like are examples thereof. These materials form bodies which are pre-hardened, relatively dense, of low ductility and flow characteristics. The other component is defined as a material created under powder-metallurgy conditions such as a sintered metal. Such powder metallurgical materials have relatively high ductile characteristics and is more easily flowable and of lower density. Other materials may be used.

The method of the present invention is further illustrated from the following specific examples of the materials and the forging apparatus used, to form unitary bevel-gear and spindle assemblies, synchronizing rings and the like.

Figure 1:
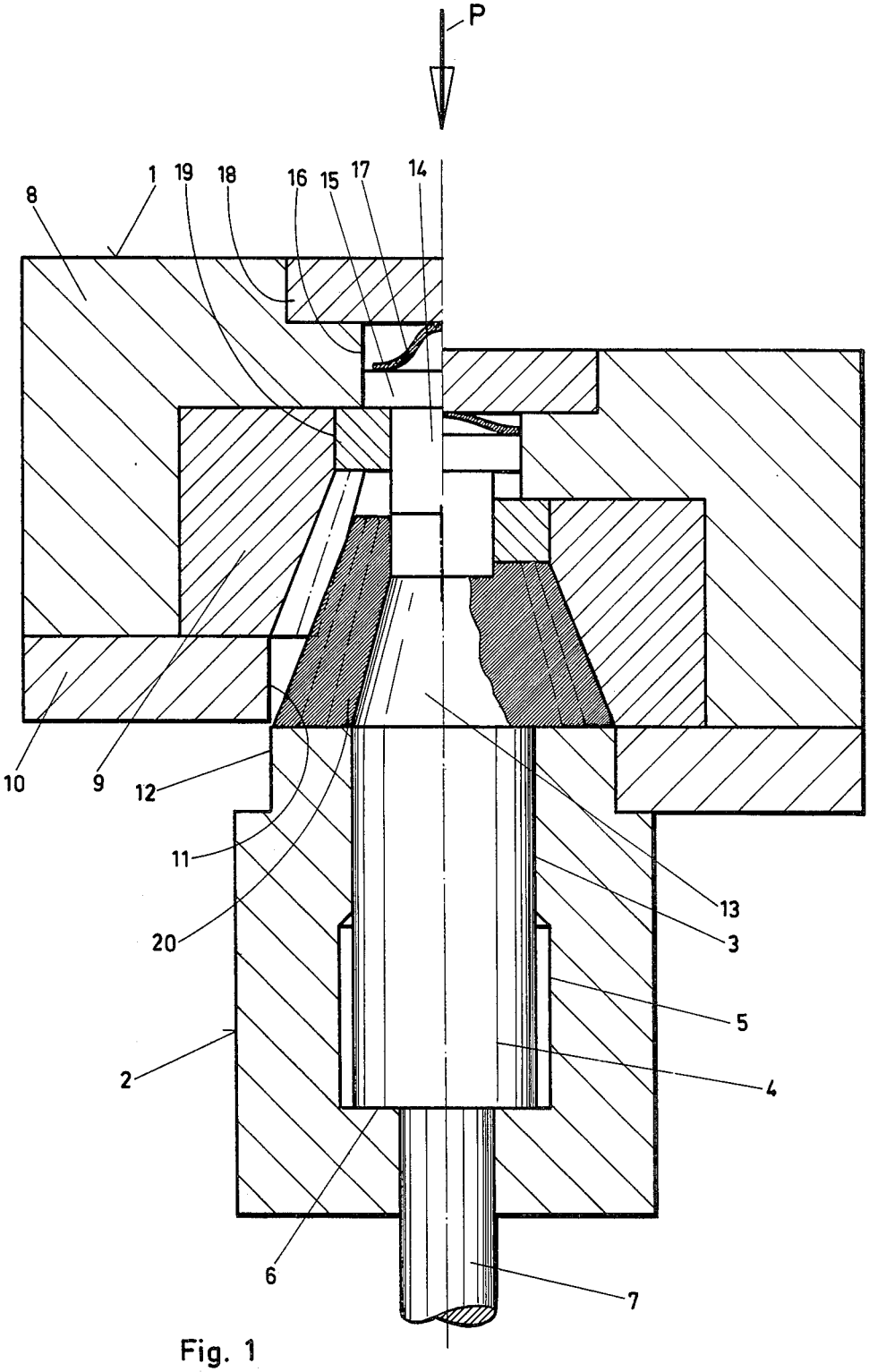
FIG. 1 is a vertical section through a two part forging press, in which the upper die part is split along its central axis to illustrate its movement with respect to the lower die part.

A forging press is illustrated in FIG. 1 comprising a movable upper die half 1 with a fixed lower die half 2, in which a central hole 3 is formed into which may be inserted a rod like blank such as a steel bar 4 providing a substantially formed spindle body. The lower portion 5 of the hole 3 is made with a slightly larger diameter than that of the steel bar to enable it to fit easily therein. The upper portion of the hole 3 conforms to the outer diameter of the bar to form a collar therefor. Engaging the bottom end 6 of the steel bar 4, which normally rests against the lower wall of the hole 3 is an ejector rod 7 extending coaxially out of the lower end of the lower die half 2.

The upper die half 1 is formed of an annular shrinkring or supporting ring 8 in which the actual die member 9, conforming to the finished workpiece, is coaxially located. The die member 9 is maintained in position relative to the supporting ring 8 by a ring shaped guide-face plate 10, which is secured to the ring 8 by suitable fastening means. The face plate 10 has a central opening 11, the inner peripheral surface of which conforms to and is adapted to slidingly fit against the corresponding annular bearing surface 12, cut away from the upper end of the lower die half 2. The upper die half 1 is adapted to be moved axially by a blow exerted in the direction of the arrow P by a ram (now shown) in conventional manner. The upper die moves downwardly being guided by the bearing surfaces 11 and 12 to close on the lower die. The left hand side of FIG. 1 illustrates the initial location of the upper die half 1 before the forging blow, while the right side of FIG. 1 illustrates the location of the upper die half 1 after the blow.

The steel bar 4 is, the present example, tapered at its upper end 13, beginning from the point at which it projects above the hole 3. The upper end of the tapered portion 13 is supported against the bottom end of a centering bolt 14 having a flanged head 15. The bolt 14 is inserted from the exterior into the upper die half 1 in the direction of the arrow P so that the head 15 becomes located within a peripherally conforming bore 16 formed on the upper surface of the supporting ring 8. The upper face of the head 15 is held in place by a dish or plate spring 17, (such as a belleville) which is stressed against the underside of a cover member 18, which forms the external closure for the bore 16. The cover member 18 is located in the corresponding recess formed in the ring 8 and is secured to the ring by suitable fastening means. In order to deal with the matter of wear the portion of the die 9 which is guided by the centering bolt 14 is formed of a separate thrust collar 19.

A pre-sintered intermediate member, adopted to be formed in the process made of powdered metallurged material, in the form of a conical toothed gearing 20 is mounted on the tapered section 13 of the steel bar 4.

The forming member is adapted to be compressed on the downward movement of the upper die being thus simultaneously shaped into the finished gear form, and limited to the steel bar 4, by upsetting of the material and causing it to flow under the pressure and heat conditions of the forge.

In addition to the die pressure, both the steel bar 4 and the conical gear blank 20 are placed under heat applied by suitable conventional induction heating units, or similar heating means employed in similar forging processes. While in the preferred form, the components should be heated and brought to the forging temperature, prior to the application of the forging blow, they may be heated after the forging blow but while they are continued under the pressure of the forging blow. In either alternative the relative materials should be brought to the appropriate forging temperatures, consistent with the nature of their materials, while the forging blow pressure is exerted.

The right hand side of FIG. 1 illustrates that following the descent of the upper die half 1, with the corresponding distortion of the dish spring 17, the height of the sintered blank gearing 20 is reduced by the length of the stroke. This may be compared in the drawing to the initial position as illustrated on the left hand side of FIG. 1. The resultant reduction in volume of the blank 20 corresponds to the achieved consolidation of the material of the finished gearing, and the change of density of the gearing during the forging process. The associated material flow, caused by the reduction of volume in conjunction with the forging heat affects the intimate union of the gearing blank 20 with the steel bar 4 in the area of its interface, i.e., the tapered section 13.

Preferably, the gearing blank 20 and the upper portion of the steel rod 4 are brought to a forging temperature of about 1,000° to 13,00° C preferably by induction heating under conventional conditions. In order to retain the bright metal surface of the members of the workpiece it is advisable for the heating to take place under a blanket of protective gas, like cracked ammonia or converted natural gas as conventionally used. On the other hand, since the temperature of the die components, themselves during the forging process will fluctuate between 100° and 300° C, due to the forging blow and their sliding contact, a lubricant should be applied in the normal conventional way to the recesses of the die before the forging procedure is instituted.

The forging operation is preferably affected with a single blow in order to insure uniform flow, and achievement of uniform density. Further, by selecting a uniform unitary die 9, enclosed within the supporting housing, prevention of the formation of any seams in the finished product is assured. On raising the upper die half 1, the finished workpiece, comprising the steel bar 4 and the now completely sintered and compressed gear 20, is easily removed from the lower die half 2 by means of the ejector 7.

A particularly close connection of the pre-sintered gear 20, which is the forming member in the forging process, and the steel bar 4, which is more or less preformed stable body in the forging process, is achieved by the process of the present invention. In the forging, the materials of the mated components flow beyond their interface boundaries in the area of the hole-and-plug connection, so that the weld joint between the two components has an indented or arcuate junction surface.

A particularly high degree of consolidation of the materials can be obtained from the present procedure when the forming member (presintered gear blank 20) and the formed body (steel bar 4) engage with one another in the hole-and-plug connection on similar conical cylindrical or rounded surfaces and where the forming member body, during the closure of the forging die, is forced further onto the engaging extension of the body, in the manner of a die press. By locating the steel bar 4 in the lower die half 2 and the forming member or gear blank 20 in the movable die half 1, as illustrated, this is accomplished. In this manner, the components engage still further in the direction of the closure of the die and thus the forging process can accordingly be affected by a single blow in the die, which is preferably provided without a seam, and without requiring de-burring.

Because of the above mentioned conical cylindrical or rounded contact between the pre-sintered forming member and the preformed steel bar providing the formed body, the axial upsetting of the workpiece in the direction of closure of the die is further assisted by a radial pressure. The radial pressure tends to subject the components that are to be united to a particularly close connection at the contact surfaces in the form of the familiar "friction welding".

In the process of heating the components prior to the forging procedure, the accepted technical rules and conditions, generally accepted, should be adhered to. In this respect it is advantageous for the heating to be carried out under a protected inert gas, and for the powder-metallurgical forming member (pre-sintered gear blank 20) to be heated to a higher temperature than the smelt-metallurgical preformed body (steel bar 4). In order to make better use of the die-stamp affect of the smelt-metallurgy produced preformed body it is expedient for that portion of the body, which penetrates into the forming member (upper conical section B) to be heated to a higher temperature than the remainder of the preformed body. It will be appreciated in this manner that in accordance with the present invention the simultaneously completion of the pressing and sintering of the forming member, is undertaken.

FIGS. 2 through 5 illustrate several examples for the development and formation of two component workpieces which when joined together form bevel-gear heads on elongated central spindles. The left hand portions of the individual illustrations shows a section through the combined components before forging, while the right hand portions of the drawing show a section through the finished forged workpiece. The shaft of the workpiece consist in each case of a smelt-metallurgy produced steel bar, which forms the "formed body" in the sense previously explained. The gearing is formed of powder-metallurgy manufacture, which is mounted at the end of the shaft and whose gear teeth and sintering are formed during the forging process. This gearing is the "forming member" in the sense previously explained.

Figure 2:
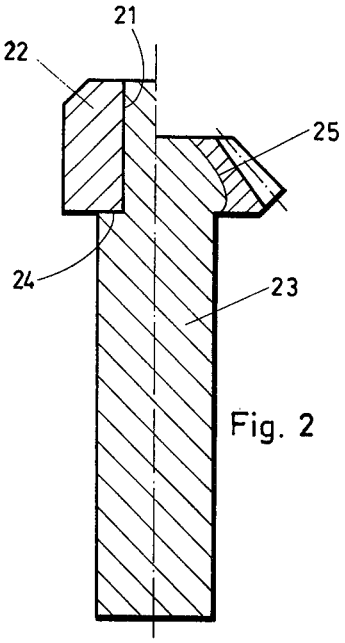
FIG. 2 through 5 respectively, illustrate the formation of unitary bevel-gears and spindles in accordance with the present invention, in each case the spindle and gear is split along its central axis to illustrate the steps of the formation.
Figure 3:
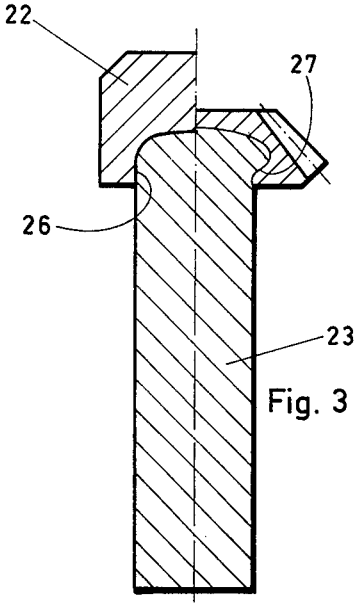

According to FIG. 2 a cylindrical bore 21 is formed in the gear ring 22 which is smaller in diameter than the diameter of the shaft 23. The shaft 23 is provided with a reduced diameter cylindrical end which enters the bore 21, and a shoulder 24 which is formed in the transition zone between the outer periphery of the shaft 23 and its turned down cylindrical end. After the forging process, this shoulder 24 and the cylindrical end of the shaft 23 produce the formation of an axially symmetrical junction surface 25 between these two components, having an approximately cross-sectional arcuate line. Simultaneously, the formation of the teeth on the gear ring are formed and the gear ring is properly compressed.

The required provision of the teeth on a workpiece simultaneous with the forging and connection of the components, can be achieved by the use of other basic forms of forging blanks more or less pre-shaped, for both the shaft and or the pre-sintered gear ring. According to FIG. 3, the connecting end of the shaft 23 is rounded off and only partially enters a correspondingly rounded off blind hole 26 formed in the gear ring 22. After the forging process, the two components are joined along the line 27 which is equivalent to that of line 22 of FIG. 2. In this case, however, a more concentrated form of tooth formation is achieved between the components which are welded or forged together.

Figure 4:
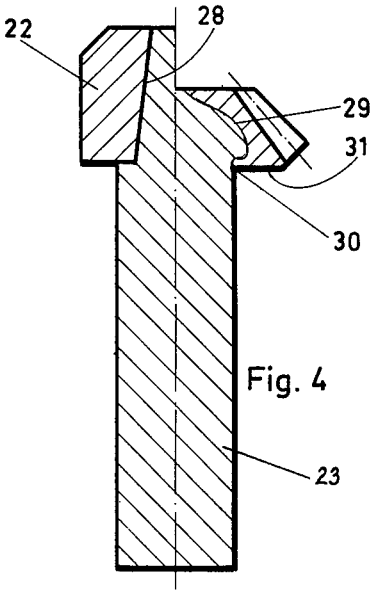

The cross-sectional form depicted in FIG. 4 illustrates a construction having a certain similarity to that of FIG. 2. The difference lies in the fact that the gear blank 22 has a central bore 28 which is conically tapered in the upper direction. The spindle or formed body 23 is similarly provided with a tapered upper end having its largest diameter substantially smaller than the diameter of the remainder of the body 23. Macrographs, taken from test specimens have shown the heavily indented junction line 29, illustrating that the union between the components has a complex arcuate curvature which results in a great union strength. It is worthy of note, that the junction line 29 runs from the inner shoulder 30 of the finished forged workpiece vertically to the rear surface 31 of the gearing 22 in an arcuate curve turned toward the central axis of the shaft 23. Such a progression of the junction line 29, as also occurs in a similar manner with regard to the embodiment of FIG. 3, ensures that the junction line does not end at any point outside of the shoulder 30, i.e. on the surface of the workpiece. Accordingly, the possibility of the development of the surface crack in the junction zone of the two components is very limited.

Figure 5:
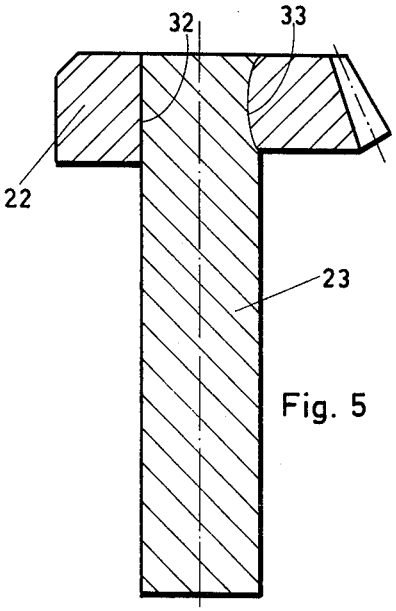

FIG. 5 illustrates a forming body such as a gearing having a cylindrical bore 32. No shoulder is formed on the shaft 23 and its outer diameter is uniform along its length, conforming to the inner diameter of the cylindrical bore 32. In the forging process, a considerable radial consolidation, in the region of the junction of the two components occurs. As a result their joining surface, as seen in section result in a convex curvature illustrated by line 33 which curvature goes inwardly within the extension of the peripheral surface of the shaft 23. If desired, the free end of the shaft need not be supported by the die components in this case.

Figure 6:
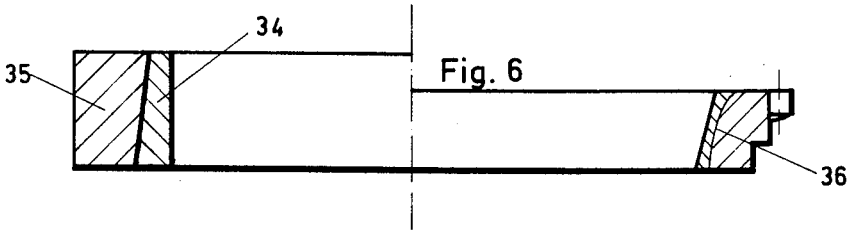
FIG. 6 is a view similar to that of FIGS. 2 through 5 showing the formation of a geared synchronizing ring.

FIG. 6 illustrates the cross-section of a snychronizing gear, in which the left hand portion shows a formed body comprising an inner ring 34 of smelt-metallurgy manufactured and a forming body, comprising the outer ring 35 surrounding the inner ring. The outer ring 35 is a powder-metallurgical blank produced prior to forging. The portion of the figure depicted in the right hand part, illustrates the fact that following forging process, a curved junction line 36 is formed, representing the boundary of the outer ring 35 and the inner ring 34. The outer ring 35 being of more material, is forged with the desired shape. The inner ring may be made of abrasive resistant material. Preferably, the two rings are provided with mating conical surfaces, prior to their forging, the degree of taper being so selective that the outer ring 35 spreads in the direction of the subequent tooth formation, while the inner ring decreases in thickness.

Figure 7:
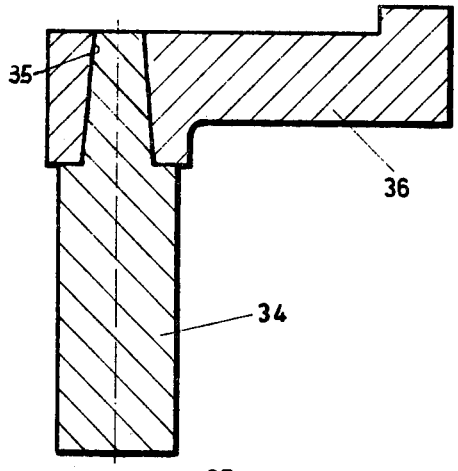
FIG. 7 is an axial section through a bevel-gear segment and shaft before formation according to the present process.
Figure 8:
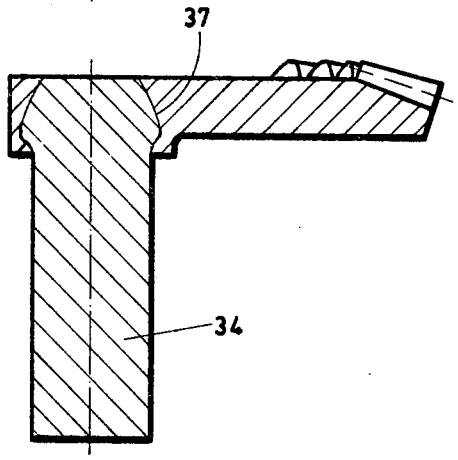
FIG. 8 is a view of the bevel-gear segment shown in FIG. 7 after forging in accordance with the present invention.
Figure 9:
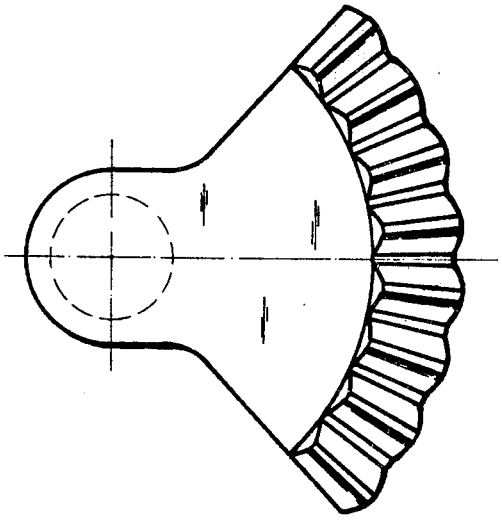
FIG. 9 is a plan view of the completed bevel-gear segment of FIGS. 7 and 8.

The formation of a tooth segment, in conjunction with a spindle shaft, is shown in FIGS. 7 through 9. In FIG. 7 the two components are illustrated before forging while FIGS. 8 and 9 illustrate the condition after forging. The initial components before forging, comprise a shaft 34 which is provide with a tapered upper end 35, which has a maximum diameter less than the shaft 34. The tapered upper end enters into a similar bore in a segment blank 36, consisting of prepressed or sintered powdered material. The shaft 34 is a steel bar of smelt-metallurgy manufacture. The union of the two blanks 34 and 36, correspond to that as previously illustrated in FIG. 4. An approximately similar projection of the junction line 37 is the logical outcome of this forging. The junction line 37 is a macrograph through the connecting surfaces between the two blanks, the materials of which become inseparably welded together in the zone of the joint surface. Essential for the formation of such a junction line 37, which bulges out radially in a pear shaped form in relation to the longitudinal axis of the shaft 34, is the upsetting effect exerted in the area of the tapering connecting surface of the two blanks and widening of the tapered upper end of the shaft 34 as illustrated in FIG. 8.

As an alternative procedure, to the forging process described at the outset, the forging press may be formed with a cavity in the lower die half, in which the actual shaped die is placed. This cavity is heated and then filled with a sintering metallic powder. A smelt-metallurgically produced body, particularly of steel or cast-steel which has been heated at least in the interface zone to the fusion temperature is placed in the upper die member and is thereafter forced into the heated metallic powder, by the closing action of the two die halves. In accordance with this variation, the separate construction of a pre-pressed or pre-sintered forming member is eliminated. The sintering and consolidation take place under simultaneous material reformation in the heated forging press the temperature of which should itself be in excess of 750° C.

Various other modifications, changes or alternate procedure steps will be obvious to those skilled in the present art. It is therefore intended that the present disclosure be taken as illustrative only of the process for forging composite articles, apparatus useful therefor and even the nature of the resultant product.

I claim:

1. A method of producing a unitary workpiece from at least two components of different materials comprising the steps of forming one of said components as a body made of a smelt-metallurgical material, forming the other of said components as a pressed and presintered forming member made of a powder-metallurgical material, one of said members having a conically tapering hole and the other of said members having a conformingly tapered plug adapted to fit in said hole in close contact therewith, thereafter locating said components in respective die-halves of a forging press in a hole and plur interconnecting arrangement, said die-halves having both radial and axial restriction surfaces for each of said components and thereafter forging said components into a desired shape by relative axial movement of said die-halves to compress the axial distance therebetween and under such conditions of heat and pressure as to upset the material of each of said components at least along the juncture of their interconnection in both the radial and axial direction to simultaneously form a welded bond therebetween.

2. The method according to claim 1 including the step of pressing said forming member, before introduction to said forging press.

3. The method according to claim 1 including the step of heating said components before applying pressure thereto.

4. The method according to claim 1 including the step of heating said components after pressure has been applied.

5. The method according to claim 1 wherein the die halves of said forging press are movable toward each other to exert pressure on said components and including the steps of causing said movement as the result of a single blow to at least one of said dies.

6. The method according to claim 1 including the step of surrounding said components with a protective gas during the forging process.

7. The method according to claim 1 including the step of selectively heating said forming member to a temperature higher than the body.

8. The method according to claim 1 including the step of selectively heating the portion of said body engaging said forming member to a higher temperature than the rest of said body.

9. A unitary two component workpiece formed according to the method of claim 1.

10. The workpiece of claim 9 wherein one component is a gearwheel and the other component is a spindle therefor.

* * * * *